United States Patent [19]

Lichtenberger

[11] Patent Number: 5,017,745

[45] **Date of Patent: * May 21, 1991**

[54] BURNER CONTROL DEVICE AND ELECTRICAL SWITCH UNIT ASSEMBLY, PARTS THERFOR AND METHODS OF MAKING THE SAME

[75] Inventor: William J. Lichtenberger, Murrysville, Pa.

[73] Assignee: Robertshaw Controls Company, Richmond, Va.

[ * ] Notice: The portion of the term of this patent subsequent to Jun. 27, 2006 has been disclaimed.

[21] Appl. No.: 340,379

[22] Filed: Apr. 19, 1989

Related U.S. Application Data

[62] Division of Ser. No. 265,037, Oct. 31, 1988, Pat. No. 4,843,198.

[51] Int. Cl.[5] ..... H01H 9/02

[52] U.S. Cl. ..... 200/307; 24/694; 403/406.1

[58] Field of Search ..... 200/307, 303, 294, 61.86; 403/406.1; 24/694

[56] References Cited

U.S. PATENT DOCUMENTS

| | | | |
|---|---|---|---|
| 1,634,230 | 6/1927 | Carr | 24/694 |
| 2,037,678 | 4/1936 | Churchill | 24/694 |
| 2,687,498 | 8/1954 | Rucks et al. | 200/307 |
| 4,249,047 | 2/1981 | Huff et al. | 200/61.86 |

*Primary Examiner*—Renee S. Luebke

*Attorney, Agent, or Firm*—Candor, Candor & Tassone

[57] ABSTRACT

A combination of a burner control device and electrical switch unit, parts therefor and methods of making the same are provided, the combination comprising a burner control device having a rotatable selector shaft and an electrical switch unit carried by the device and being operated by the selector shaft, the device having a cover secured thereto by a plurality of screws each having a head, the switch unit having a plurality of cavities therein respectively receiving the heads of the screws therein, at least one of the cavities having a snap-fit structure therein that is snap-fitted to its respective head to hold the switch unit to the device.

2 Claims, 4 Drawing Sheets

BURNER CONTROL DEVICE AND ELECTRICAL SWITCH UNIT ASSEMBLY, PARTS THERFOR AND METHODS OF MAKING THE SAME

CROSS REFERENCE TO RELATED APPLICATION

This application is a divisional patent application of its copending parent patent application, Ser. No. 265,037, filed Oct. 31, 1988, now U.S. Pat. No. 4,843,198.

1. Field of the Invention

This invention relates to a new combination of a burner control device and an electrical switch unit carried by the device as well as to a new control device for such a combination, a new switch unit for such a combination and to new methods of making the same, the burner control device being adapted to control the flow of gaseous fuel to a top burner of a cooking apparatus or the like and the electrical switch unit being adapted to control the electrical ignition means for initially igniting the fuel issuing from the burner.

2. Prior Art Statement

It is known to provide a combination of a burner control device having a rotatable shaft and an electrical switch unit carried by the device and being operated by the selector shaft, the device having a cover secured thereto by a plurality of screws each having a head and the switch unit having a plurality of cavities therein respectively receiving the heads of the screws therein. For example, see the U.S. Pat. No. 4,249,047 to Huff et al.

Also see the U.S. Pat. No. 4,342,886 to Demi, which discloses a switch unit that is snap-fitted to a burner control device.

SUMMARY OF THE INVENTION

It is one feature of this invention to provide unique means for securing an electrical switch unit to a burner control device.

In particular, it was found according to the teachings of this invention that by modifying the conventional screws utilized for normally holding a cover to a burner control device, such modified screws can be utilized for snap-fitting to snap-fit means of an electrical switch unit that is to be carried by the device and be operated by the selector shaft thereof whereby such screws provide the dual function of securing the cover to the burner control device and securing the electrical switch unit to the burner control device.

For example, one embodiment of this invention provides a combination of a burner control device having a rotatable selector shaft and an electrical switch unit carried by the device and being operated by the selector shaft, the device having a cover secured thereto by a plurality of screws each having a head, the switch unit having a plurality of cavities therein respectively receiving the heads of the screws therein, at least one of the cavities having snap-fit means therein that is snap-fitted to its respective head to hold the switch unit to the device.

Accordingly, it is an object of this invention to provide a new combination of a burner control device and an electrical switch unit, the combination of this invention having one or more of the novel features of this invention as set forth above or hereinafter shown or described.

Another object of this invention is to provide a new method of making such a combination, the method of this invention having one or more of the novel features of this invention as set forth above or hereinafter shown or described.

Another object of this invention is to provide a new burner control device for carrying an electrical switch unit, the device of this invention having one or more of the novel features of this invention as set forth above or hereinafter shown or described.

Another object of this invention is to provide a new method of making such a burner control device, the method of this invention having one or more of the novel features of this invention as set forth above or hereinafter shown or described.

Another object of this invention is to provide a new electrical switch unit to be carried by a burner control device, the electrical switch unit of this invention having one or more of the novel features of this invention as set forth above or hereinafter shown or described.

Another object of this invention is to provide a new method of making such an electrical switch unit, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
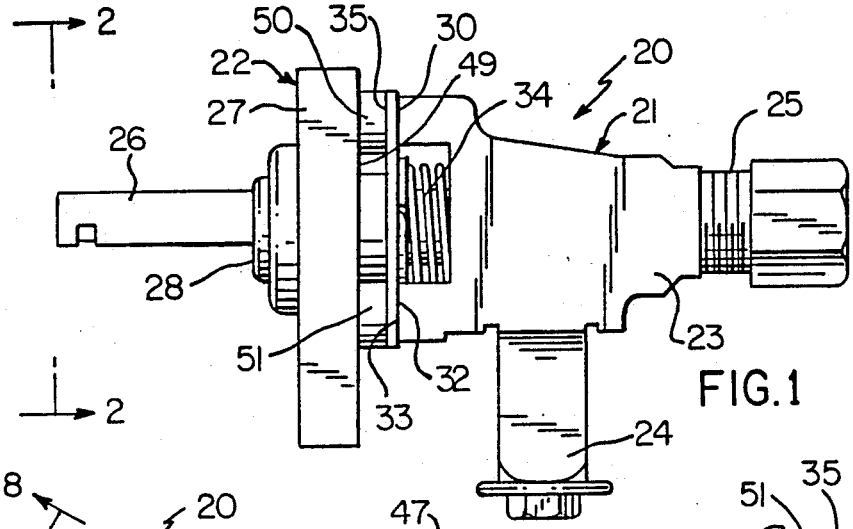
FIG. 1 is a side view of one combination of a burner control device and an electrical switch unit of this invention.

While the various features of this invention are hereinafter illustrated and described as being particularly adapted to provide a combination of a burner control device and an electrical switch unit for controlling a top burner means of a domestic cooking apparatus or the like, it is to be understood that the various features of this invention can be utilized singly or in various combinations thereof to provide a combination for controlling other apparatus as desired.

Therefore, this invention is not to be limited to only the embodiments illustrated in the drawings, because the drawings are merely utilized to illustrate one of the wide variety of uses of this invention.

Figure 2:
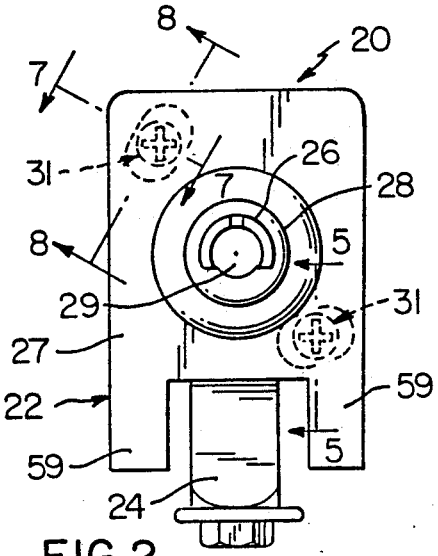
FIG. 2 is a front view of the combination of FIG. 1 and is taken in the direction of the arrows 2—2 of FIG. 1.
Figure 3:
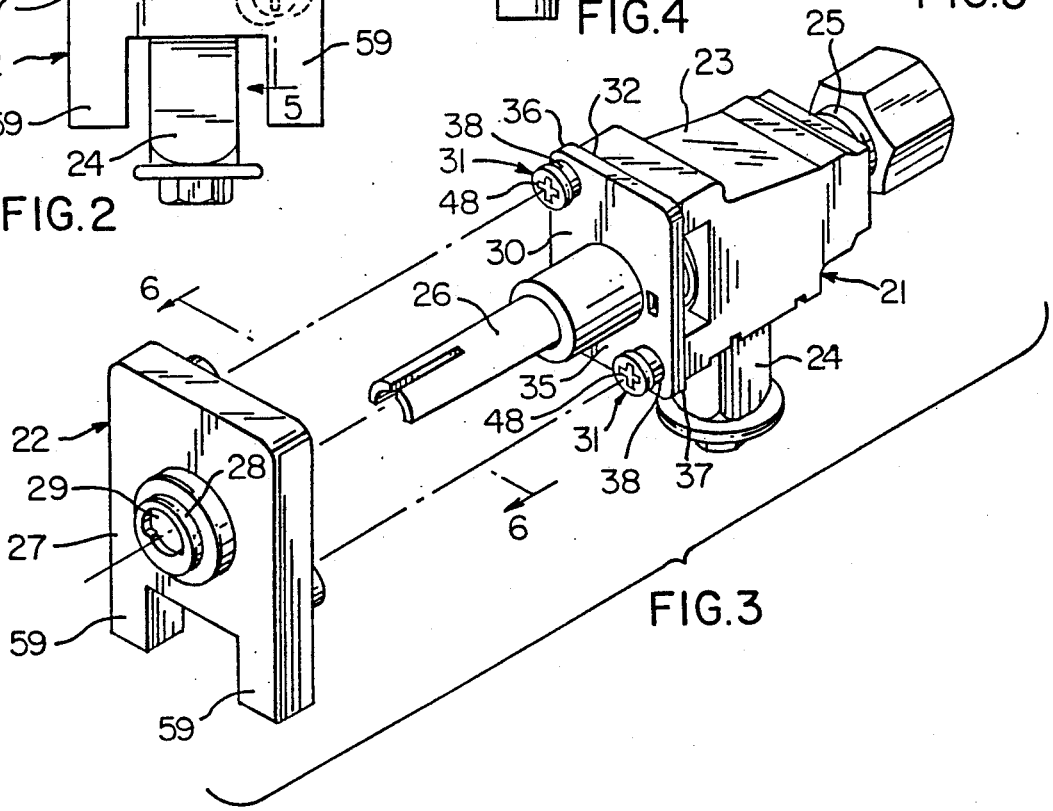
FIG. 3 is an exploded perspective view of the burner control device and the electrical switch unit of FIG. 1.

Referring now to FIGS. 1, 2 and 3, one combination of this invention is generally indicated by the reference numeral 20 and comprises a burner control device 21 and an electrical switch unit 22 being carried thereby.

The burner control unit 21 comprises a housing means 23 formed of any suitable material, such as the metallic material that is illustrated in the drawings, and having an inlet means 24 for being interconnected to a supply (not shown) of gaseous fuel or the like and an outlet means 25 for being interconnected to a burner (not shown) of a cooking apparatus or the like when suitable valve structure (not shown) within the housing means 21 is opened by an operator properly rotating a selector shaft 26 of the control device 21 to an "on" condition thereof in a manner well known in the art. For example, see the aforementioned two U.S. patents, the U.S. Pat. No. 4,249,047, to Huff et al, and the patent to Demi, U.S. Pat. No. 4,342,886 whereby these two U.S. patents are being incorporated into this disclosure by this reference thereto.

The electrical switch unit 22 that is carried by the control device 21 in a manner hereinafter set forth has a housing means 27 formed of any suitable material, such as the plastic material illustrated in the drawings, and containing electrical switch structure (not shown) therein that is adapted to be operated by a rotatable actuator means 28 thereof when the actuator means 28 has been rotated by the selector shaft 26 a certain amount as is well known in the art, the electrical switch unit 22 being adapted to control the electrical ignition means for the burner controlled by the control device 21 also in a manner well known in the art as fully set forth in the aforementioned two U.S. patents.

Therefore, the details of the operating structure of the electrical switch unit 22 and the control device 21 for controlling the operation of a burner means of a cooking apparatus utilizing the combination 20 will not be further described as the same is conventional in the art and only the details thereof necessary to understand the features of this invention will be hereinafter set forth.

The switch unit 22 has an opening means 29 passing therethrough and being shaped in a manner to receive a portion of the selector shaft 26 of the control device 21 therethrough when the switch unit 22 is assembled to the control device 21 in a manner hereinafter set forth so that the shaft 26 is effectively interconnected to the actuator 28 of the switch unit 22 in a keyed or splined manner to cause the actuator 28 to rotate in unison with the selector shaft 26 all in a manner well known in the art.

The control device 21 has a substantially flat plate-like cover 30 secured thereto by screws 31 so that the side 32 of the cover 30 is secured against surface means 33 of the control device 21 so as to protect and hold internal structure 34 of the control device 21 in its proper position as is well known in the art, the cover 30 being formed of any suitable material, such as the metallic material illustrated in the drawings.

The other side 35 of the cover plate 30 is substantially flat and has a pair of openings (not shown) adjacent the corners 36 and 37 thereof for receiving the screws 31 therethrough so that the enlarged heads 38 of the screws 31 will abut against the side 35 of the cover 30 to compact the cover 30 against the side 33 of the housing 21 during the securement of the cover 30 to the housing 31, the screws threading into suitable threaded openings (not shown) formed in the housing means 23 of the control device 21 in a manner well known in the art.

However, each screw 31 is formed in a unique manner according to the teachings of this invention to permit the switch unit 22 to be snap-fitted thereto when the switch unit 22 is assembled to the control device 21.

Figure 4:
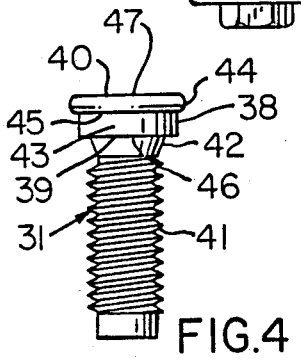
FIG. 4 is an enlarged side view of the new screw of this invention utilized for interconnecting the electrical switch unit and burner control device of FIGS. 1-3 together.

In particular, it can readily be seen in FIGS. 3 and 4 that the enlarged head 38 of each screw 31 is substantially cylindrical throughout the axial length thereof and has opposed ends 39 and 40, the end 39 being spaced from a threaded portion 41 of the screw 31 by a reduced sized intermediate section 42 with the end 39 having a diameter that is larger than the diameter of the threaded portion 41. The other end 40 of the head 38 is adapted to be disposed remote from the cover plate 30 and be spaced therefrom by a cylindrical body portion 43 of the head 38, the end 40 having a diameter that is larger than the diameter of the body portion 43 while having an arcuate peripheral surface 44 that defines a shoulder 45 adjacent the body portion 43 for snap-fit purposes as will be apparent hereinafter.

Therefore, it can be seen that when the screws 31 are utilized to secure the cover plate 30 to the housing means 23 of the control device 21, shoulders 46 of the heads 38 of the screws 31 that are defined by the ends 39 and the reduced portions 42 will abut against the side 35 of the cover plate 30 to compact the cover plate 30 against the surface 33 of the housing means 23 in the manner illustrated in FIGS. 1 and 2 while the enlarged free ends 40 are spaced outwardly from the surface 35 of the cover plate 30 by the body portions 43 of the heads 38.

The end surface 47 of the free end 40 of the enlarged head 38 of each screw 31 is provided with a suitably shaped recess 48 therein for receiving a conventional turning tool in order to screw the screw 31 into the threaded opening (not shown) formed in the housing means 23 of the control device 21 to secure the cover plate 30 thereto in the manner previously set forth.

Figure 6:
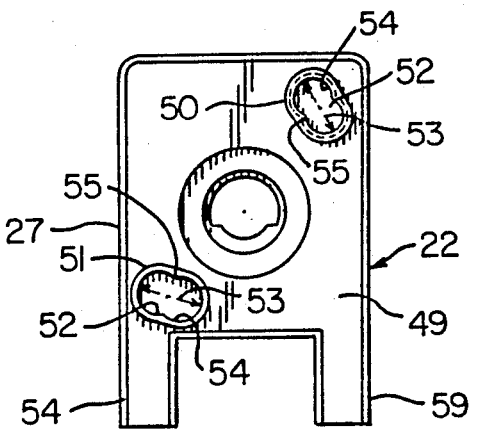
FIG. 6 is a rear view of the electrical switch unit of FIG. 3 and is taken in the direction of the arrows 6—6 of FIG. 3.

The housing means 27 of the switch unit 22 has a substantially flat end wall means 49 as illustrated in FIG. 6 and has two projections 50 and 51 extending therefrom and each having a cavity 52 interrupting the same so as to permit the enlarged heads 38 of the screws 31 of the control device 21 to be respectively received therein when the switch unit 22 is telescoped onto the selector shaft 26 and pushed toward the housing means 23 of the control device 21 as illustrated in the drawings.

The cavities 52 in the projections 50 and 51 are generally oblong in configuration and respectively have the long dimension thereof as represented by the reference numeral 53 in FIG. 6 disposed at an angle relative to each other, rather than being parallel to each other or disposed at right angles relative to each other, in order to compensate for any tolerance differences between the location of the screw heads 38 on the control device 21 and the alignment of the cavities 52 of switch unit 22 on the shaft 26 during the assembly thereof.

The cavities 52 of the switch unit 22 define internal peripheral surfaces 54 in the projections 50 and 51 with the internal peripheral surfaces 54 having opposed medial portions 55 that are disposed closer to each other so as to cause the free ends 40 of the screw heads 38 to be press fitted between the medial portions 55 when the same are received within the respective cavities 52.

Figure 5:
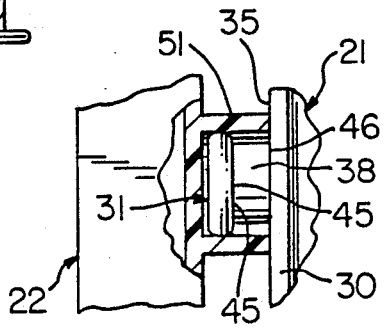
FIG. 5 is an enlarged fragmentary view that is partially in cross section and is taken in the direction of the arrows 5—5 of FIG. 2.
Figure 7:
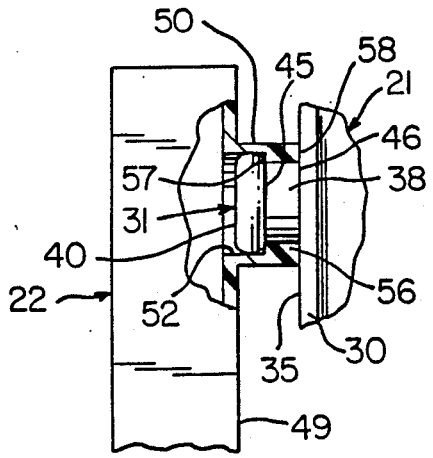
FIG. 7 is an enlarged fragmentary view that is partially in cross section and is taken in the direction of the arrows 7—7 of FIG. 2.

The projection 50 of the switch unit 22 has the cavity 52 thereof undercut the outer portion 56 of the projection 50 to define an internal shoulder 57 which will snap-fit over the free end 40 of its respective screw head 38 and bear against the snap-fit surface 45 of the free end 40 in the manner illustrated in FIG. 7 to secure the switch unit 22 onto the control device 21, the free edge means 58 of the tubular projections 50 and 51 respectively substantially abutting against the front surface 35 of the cover plate 30 at the time the surfaces 45 and 57 snap-fit together in the manner illustrated in FIGS. 5 and 7.

Thus, it can be seen that while only the projection 50 of the switch housing 27 snap-fits with its respective screw 31 of the control device 21, the other projection 51 could be made to snap-fit with its respective screw head 38 if desired rather than merely be press-fit therewith in the manner illustrated in FIG. 5.

Therefore, it can be seen that it is a relatively simple method of this invention to form the control device 21 and electrical switch unit 22 so as to permit the same to be snap-fit together when the switch unit 22 is assembled with the control device 21 by having the switch unit 22 telescoped onto the selector shaft 26 and be pushed toward the housing means 23 of the control device 21 with the cavities 50 aligning with the screw heads 38 so that at least one of the screw heads 38 will snap-fit with its respective tubular projection 50 in the manner previously set forth to hold the switch unit 22 in its assembled relation with the control device 21. During such assembly operation, it can be seen that the arcuate leading edge means 44 of the heads 38 of the screws 31 facilitate the insertion of the heads 38 into the cavities 52 of the projections 50 and 51 in a camming manner.

It can be seen that the switch housing 27 has spaced apart portions 59 for permitting external electrical lead means to be respectively electrically interconnected to the switch structure with the housing means 27 in a conventional manner, the cavities 52 and their cooperating screw heads 38 orienting the portions 59 for properly receiving their lead means as well as orienting the switch housing 27 relative to the switch actuating cam lobe (not shown) of the actuator 28 that is keyed or splined to the selector shaft 26 of the control device 21.

Figure 10:
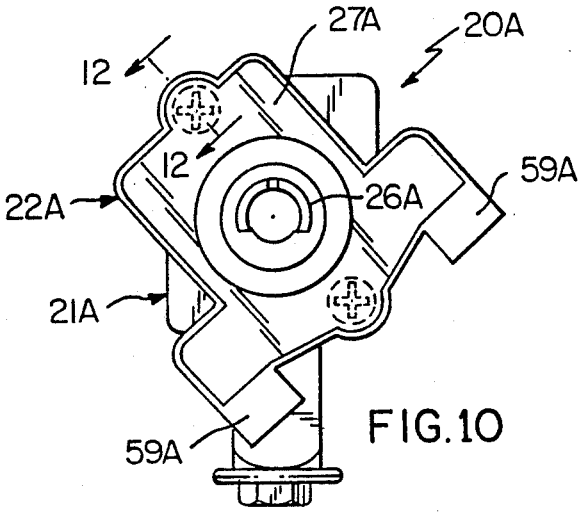
FIG. 10 is a frontview of the combination of FIG. 9 and is taken in the direction of the arrows 10—10 thereof.
Figure 8:
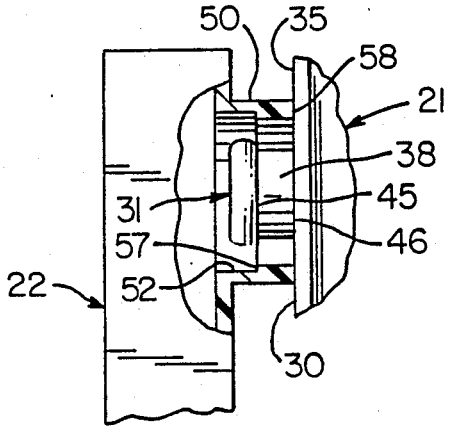
FIG. 8 is a view similar to FIG. 7 and is taken in the direction of the arrows 8—8 of FIG. 2.
Figure 9:
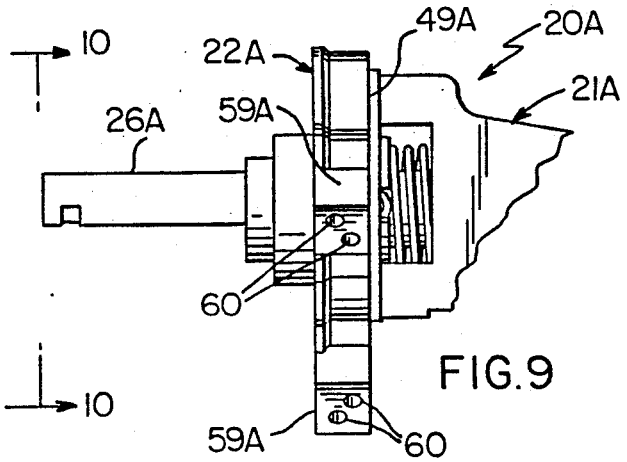
FIG. 9 is a fragmentary view similar to FIG. 1 and illustrates another combination of a burner control device and an electrical switch unit of this invention.
Figure 11:
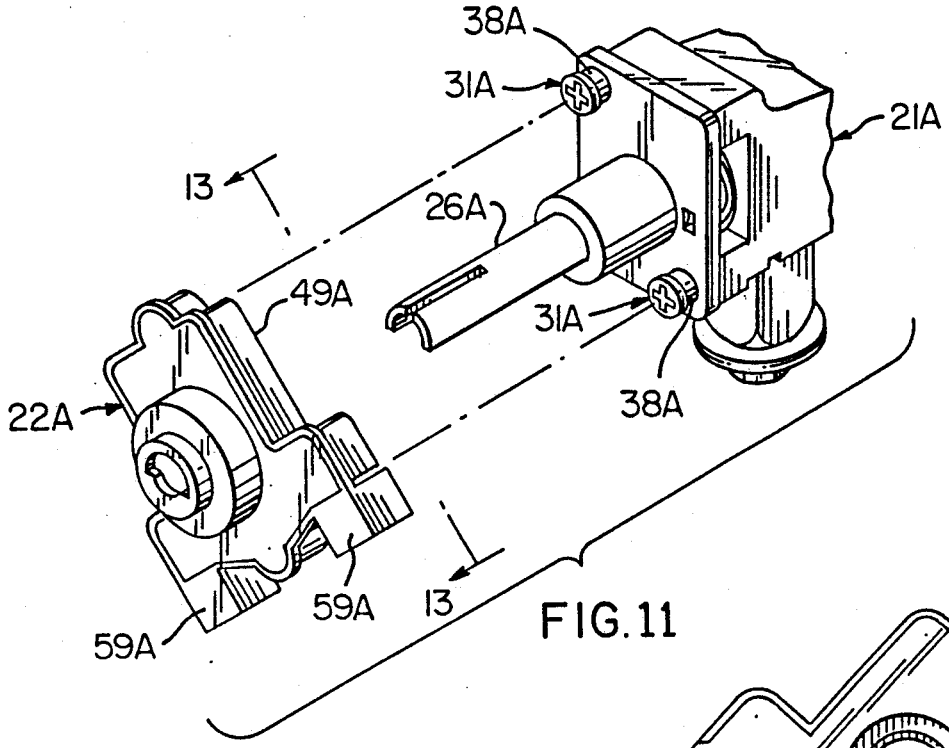
FIG. 11 is an exploded perspective view of the burner control device and the electrical switch unit of FIG. 9.
Figure 13:
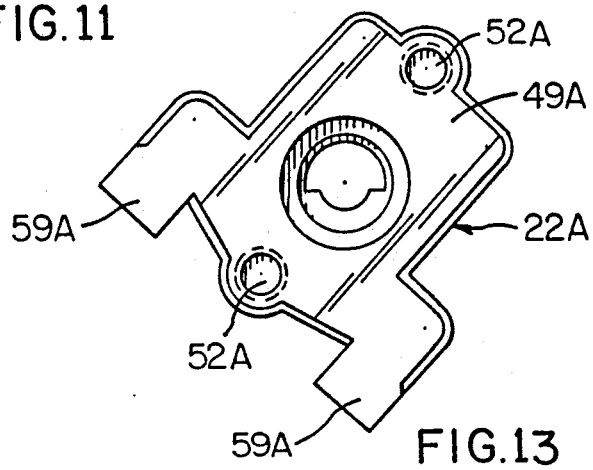
FIG. 13 is a rear view of the electrical switch unit of FIG. 11 and is taken in the direction of the arrows 13—13 of FIG. 11.

Another combination of this invention is generally indicated by the reference numeral 20A in FIGS. 9, 10 and 11 and parts thereof that are similar to the combination 20 previously described are indicated by like reference numerals followed by the reference letter "A".

Figure 12:
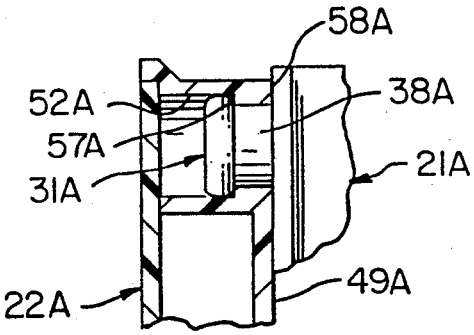
FIG. 12 is an enlarged fragmentary view that is partially in cross section and is taken on the line 12—12 of FIG. 10.

While the control device 21A of the combination 20A is substantially identical to the control device 21 previously described, the electrical switch unit 22A therefor has the housing means 27A thereof formed in a different configuration and has the cavities 52A thereof directly interrupt the rear surface 49A of the housing means 27A without requiring the tubular projections 50 and 51 previously set forth. In addition, the cavities 52A are generally circular in configuration and each provide an undercutting function so as to define annular snap-fit shoulder means 57A within each cavity 52A at a point spaced inwardly from the end surfaces 58A thereof as illustrated in FIG. 12.

In this manner, both screw heads 38A of the control device 21A are snap-fitted within the cavities 52A when the switch unit 22A is assembled onto the selector shaft 26A in the manner previously described.

The terminal receiving portions 59A of the switch unit 22A are disposed in an angled relation relative to the control device 21A when the switch unit 22A is assembled thereto so as to facilitate the interconnection of the external lead means thereto which can be inserted in openings 60 thereof as illustrated in FIG. 9.

Figure 14:
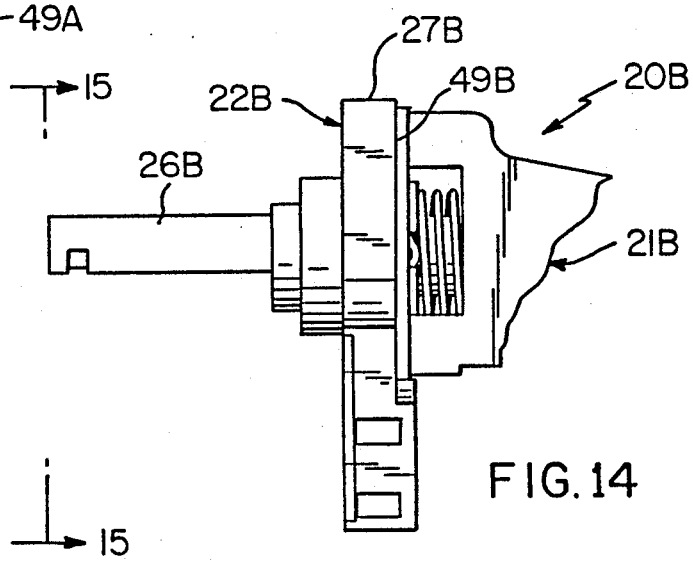
FIG. 14 is a view similar to FIG. 9 and illustrates another combination of a burner control device and an electrical switch unit of this invention.
Figure 15:
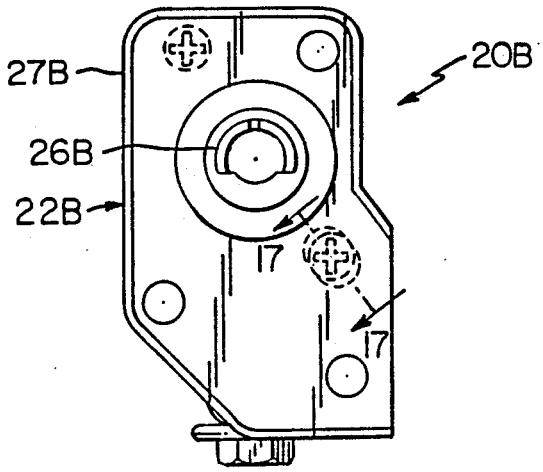
FIG. 15 is a front view of the combination of FIG. 14 and is taken in the direction of the arrows 15—15 of FIG. 14.
Figure 18:
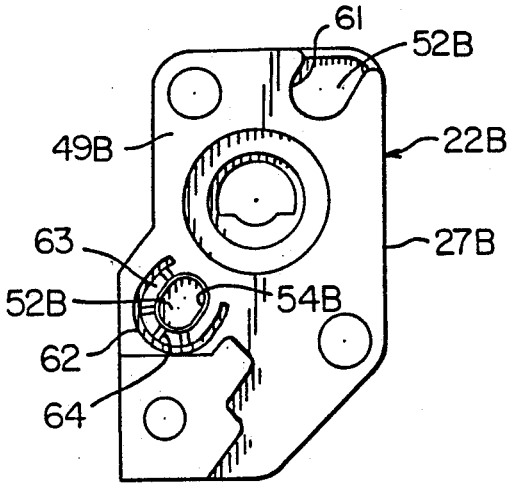
FIG. 18 is a rear view of the electrical switch unit of FIG. 16 and is taken in the direction of the arrows 18—18 of FIG. 16.
Figure 16:
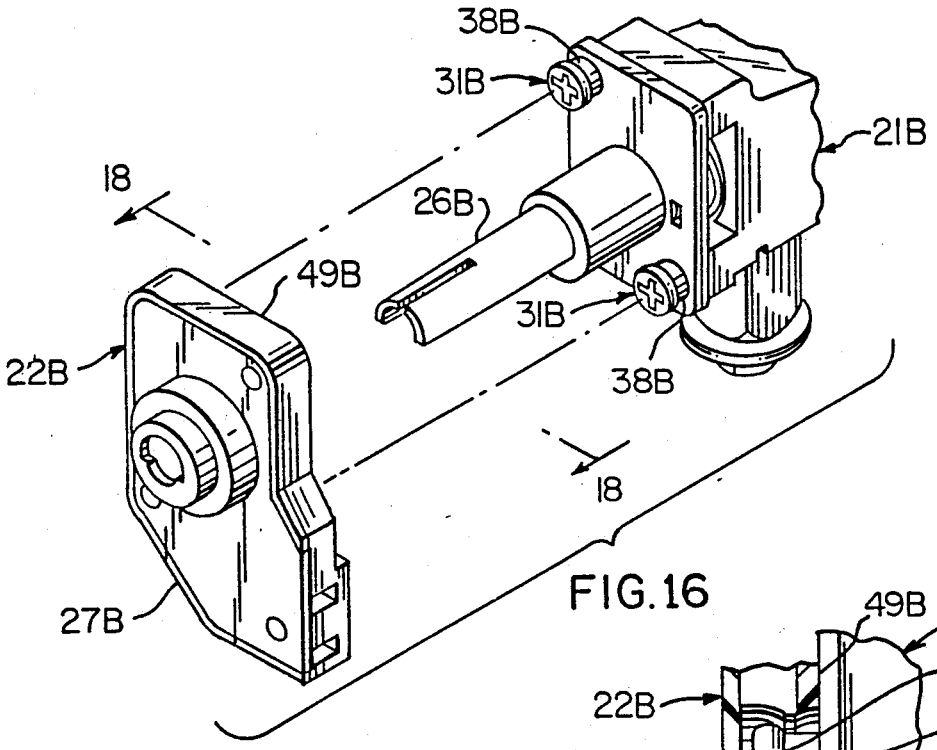
FIG. 16 is an exploded perspective view of the burner control device and the electrical switch unit of FIG. 14.

Another combination of this invention is generally indicated by the reference numeral 20B in FIGS. 14–16 and parts thereof similar to the combination 20 are indicated by like reference numerals followed by the reference letter "B".

As in the combination 20A previously described, the control device 21B for the combination 20B is substantially the same as the control device 21 previously described whereas the electrical switch unit 22B has its housing means 27B not only formed with a different configuration, but also has the cavities 52B thereof directly interrupt the end surface 49B of the housing means 27B without having the tubular projections 50 and 51 previously described.

In addition, only one of the cavities 52B defines an oval or oblong structure 54B which provides a snap-fit function in a manner hereinafter set forth while the other cavity 52B defines a peripheral structure 61 which merely orients with its respective screw head 38B without a snap-fit therewith.

The end surface 49B of the switch unit 22B has an arcuate slot 62 formed therein which partially surrounds the cavity 52B and defines a thin wall section 63 of the housing means 27B which is further divided by a plurality of transverse slots 64 to render the wall section 63 relatively flexible and thereby permit the respective screw head 38B to be inserted into the snap-fit cavity 52B.

Figure 17:
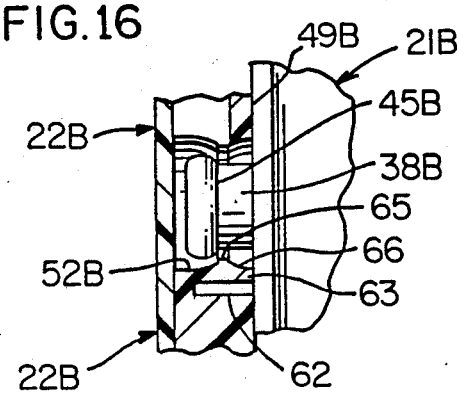
FIG. 17 is an enlarged fragmentary view that is partially in cross section and is taken in the direction of the arrows 17—17 of FIG. 15.

As illustrated in FIG. 17, the snap-fit cavity 52B is so formed that the same defines an internal snap-fit portion 65 that has a camming surface 66 leading from the surface 49B so that the snap-fit means 65 will snap-fit against the surface 45B of its respective screw head 38B when the same is fully inserted therein in the manner illustrated in FIG. 17.

Therefore, it can be seen that when the switch unit 22B is assembled to the control device 21B in the manner previously described, not only does the camming surface 66 facilitate the insertion of the enlarged head portion 40B of its respective screw 31B to enter into the cavity 52B and snap past the snap-fit means 65, but also the resiliency of the thin wall portion 63 facilitates such snap-fitting arrangement so that the switch unit 22B will be snap-fitted to the control device 21B in the manner illustrated in FIG. 17.

Therefore, it can be seen that in all of the embodiments 20, 20A and 20B of this invention, the respective switch unit 22, 22A and 22B can be readily assembled to its respective control device 21, 21A and 21B through a snap-fitting relation between at least one cavity 52, 52A and 52B of the switch unit 22, 22A and 22B and its respective screw head 38, 38A and 38B of a screw 31, 31A and 31B that performs the dual function of securing a cover plate 30, 30A and 30B to its respective housing means 23, 23A and 23B as well as the switch unit 22, 22A and 22B thereto.

Of course, the switch units 22, 22A and 22B can be respectively disassembled from their respective control devices 21, 21A and 21B by merely unsnap-fitting their respective cavities 52, 52A and 52B from their respective screw heads 38, 38A and 38B. Such unsnapping can be facilitated by properly shaping the respective snap-fit cavities 52, 52A and 52B. For example, see FIG. 17 wherein the cavity 52B has a camming surface 68 for facilitating the unsnapping of the screw head 38B from the cavity 52B.

Therefore, it can be seen that this invention not only provides a new combination of a burner control device and an electrical switch unit and method of making the same, but also this invention provides new parts for such a combination and new methods of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In an electrical switch unit adapted to be carried by a burner control device and be operated by a selector shaft of said device which has a cover secured thereto by a plurality of screws each having a head, said switch unit having a plurality of cavities therein for respectively receiving said heads of said screws therein, the improvement wherein at least one of said cavities has snap-fit means therein that is adapted to be snap-fitted to its respective head to hold said switch unit to said device, said cavities each being substantially oblong in configuration.

2. An electrical switch unit as set forth in claim 1 wherein said oblong cavities have the long dimensions thereof angled relative to each other.

* * * * *